US005201440A

United States Patent [19]

Gross

[11] Patent Number: 5,201,440

[45] Date of Patent: Apr. 13, 1993

[54] CLOSURE WITH TAMPER-EVIDENT TEAR-OFF PANEL UNITARY WITH A FLOW CONTROL ELEMENT

[75] Inventor: Richard A. Gross, Oconomowoc, Wis.

[73] Assignee: Seaquist Closures, a division of Pittway Corporation, Mukwonago, Wis.

[21] Appl. No.: 775,719

[22] Filed: Oct. 11, 1991

[51] Int. Cl.[5] ..... B67B 5/00

[52] U.S. Cl. ..... 222/153; 222/541; 222/556; 215/203; 215/253; 215/254; 220/269

[58] Field of Search ..... 222/153, 541, 556; 215/201, 203, 253-256; 220/266, 268-270

[56] References Cited

U.S. PATENT DOCUMENTS

| | | | |
|---|---|---|---|
| 2,950,834 | 8/1960 | Mazza . | |
| 3,131,824 | 5/1964 | Van Baarn | 222/541 |
| 3,391,847 | 7/1968 | Christine et al. . | |
| 3,419,198 | 12/1968 | Pettersen . | |
| 3,480,184 | 11/1969 | Landis . | |
| 3,651,992 | 3/1972 | Hazard . | |
| 3,744,682 | 7/1973 | Blank . | |
| 3,966,080 | 6/1976 | Bittel . | |
| 4,022,352 | 5/1977 | Pehr . | |
| 4,067,482 | 1/1978 | Vogel et al. . | |
| 4,127,221 | 11/1978 | Vere . | |
| 4,142,650 | 3/1979 | Almouli . | |
| 4,170,315 | 10/1979 | Dubach et al. . | |
| 4,231,486 | 11/1980 | Bock . | |
| 4,244,495 | 1/1981 | Lorscheid et al. . | |
| 4,265,367 | 5/1981 | Vogt | 222/541 X |
| 4,291,818 | 9/1981 | Nozawa et al. . | |
| 4,361,250 | 11/1982 | Foster . | |
| 4,371,088 | 2/1983 | Gach . | |
| 4,397,400 | 8/1983 | Walter . | |
| 4,431,110 | 2/1984 | Roth . | |
| 4,462,504 | 7/1984 | Roth et al. . | |
| 4,467,931 | 8/1984 | Gach . | |
| 4,487,324 | 12/1984 | Ostrowsky . | |
| 4,592,480 | 3/1986 | Hart et al. | 222/541 X |
| 4,595,123 | 6/1986 | Libit . | |
| 4,602,718 | 7/1986 | Dutt . | |
| 4,610,371 | 9/1986 | Karkiewicz . | |
| 4,711,363 | 12/1987 | Marino . | |
| 4,711,372 | 12/1987 | Gach . | |
| 4,711,380 | 12/1987 | Ulm . | |
| 4,733,787 | 3/1988 | Knopf et al. . | |
| 4,736,858 | 4/1988 | Shastal . | |
| 4,778,072 | 10/1988 | Newman . | |
| 4,796,771 | 1/1989 | Stettler | 215/253 |
| 4,852,770 | 8/1989 | Sledge et al. . | |
| 4,919,286 | 4/1990 | Agbay, Sr. | 215/254 X |
| 4,941,592 | 7/1990 | Kitterman . | |
| 4,969,574 | 11/1990 | Shastal . | |

FOREIGN PATENT DOCUMENTS 1333334 5/1971 United Kingdom .

OTHER PUBLICATIONS

"Tamper Resistant Packaging from 3M" brochure (2 pages).

*Primary Examiner*—Andres Kashnikow
*Assistant Examiner*—Kenneth DeRosa
*Attorney, Agent, or Firm*—Dressler, Goldsmith, Shore, Sutker & Milnamow, Ltd.

[57] ABSTRACT

A container closure includes a body for mounting on the container. The body defines a dispensing orifice. A flow control device, such as a lid, is disposed on the body for being moved between positions opening and closing the dispensing orifice. A tamper-indicating member is provided as a unitary extension from the lid. A first frangible web connects the member to the lid. An anchor is connected with a second frangible web to another portion of the tamper-indicating member, and the anchor is retained by the closure body. The tamper-indicating member also includes a graspable pull tab. The tab can be pulled to completely sever the frangible webs connecting the tamper-indicating member to the lid and to the anchor. This permits the lid to be opened while providing evidence of tampering with the closure.

20 Claims, 3 Drawing Sheets

CLOSURE WITH TAMPER-EVIDENT TEAR-OFF PANEL UNITARY WITH A FLOW CONTROL ELEMENT

TECHNICAL FIELD

This invention relates to closures for containers and, in particular, to a closure which has a tamper-evident feature that can be readily manipulated by the user to permit opening of the closure while providing a clear indication of such manipulation.

BACKGROUND OF THE INVENTION AND TECHNICAL PROBLEMS POSED BY THE PRIOR ART

A variety of container closures have been developed or proposed wherein an initial opening of a lid or a dispensing spout structure provides visual evidence of such an occurrence—even after the lid or spout has been subsequently closed.

See, for example, the U.S. Pat. Nos. 4,487,324 and the 4,941,592 which are assigned to Seaquist Closures, Crystal Lake, Ill., U.S.A. The closures disclosed in these patents incorporate a locking band or tab which is attached to either the lid or body of the closure with a plurality of frangible webs so as to initially retain the closure lid to the body in the closed position To initially open the closure, the user must break the frangible webs by pushing or pulling on the tab or band.

While these closures can function well for the purposes for which they have been designed, it would be desirable to provide an improved tamper-evident closure which could be readily fabricated with certain types of lids or flow control elements and which, prior to the initial opening, could blend in with, or enhance, the cosmetic appearance of the closure.

Further, it would be advantageous if such an improved closure could be adapted for use on certain closure designs so as to furnish a very clear indication that the closure has been initially opened.

It would also be desirable to provide an improved tamper-evident closure design wherein a portion of the closure could be easily, and completely, removed for use as a "proof-of-purchase" panel or label.

The present invention provides an improved closure which can accommodate designs having the above-discussed benefits and features.

SUMMARY OF THE INVENTION

The present invention provides a novel tamper-evident dispensing feature which blends well with, and/or enhances, the cosmetic appearance of the closure and yet can be easily manipulated by the user to permit the closure to be opened It gives a clear indication of an initial opening of the closure The feature can be adapted for use in a variety of dispensing closure designs.

The feature can be incorporated in a closure having a body suitable for mounting on a container. The body defines a dispensing orifice for communicating with the container for dispensing the contents thereof.

A flow control means is disposed on the body for being moved between positions opening and closing the dispensing orifice.

In a preferred embodiment, the body has a top wall which defines the dispensing orifice and has a peripheral skirt depending from the top wall. The flow control means includes a lid which is pivotally mounted about an axis adjacent the rear end of the lid, and the lid preferably has a front end remote from the rear end which lies adjacent the body skirt when the lid is closed.

A tamper-indicating member is provided unitary with the flow control means, and a first frangible connecting means or web connects the tamper-indicating member to the flow control means Preferably, the tamper-indicating member is connected to the distal end of the flow control means along a line generally parallel to a pivot axis of the flow control means.

An anchor means is provided unitary with the tamper-indicating member for being retained on the body skirt. In a preferred embodiment, the body skirt defines an anchor-receiving aperture, and the anchor means includes locking means for being inserted through the anchor-receiving aperture for engaging the body and preventing removal of the anchor means from the body.

A second frangible connecting means or web connects the anchor means to the tamper-indicating member. In the preferred embodiment, the tamper-indicating member and anchor means are connected by the second frangible connecting means along a line generally parallel with a pivot axis of the flow control means.

The tamper-indicating member also preferably includes a pull tab by which the member can be pulled to completely sever the member from both the flow control means and anchor means along the first and second frangible webs. This permits the flow control means to be opened and provides evidence of tampering with the closure.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

Figure 1:
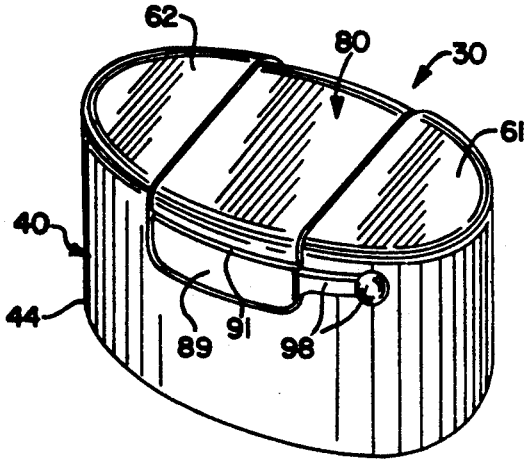
FIG. 1 is a perspective view of a first embodiment of the closure according to the present invention.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in a normal (upright) storage position, and terms such as upper, lower, horizontal, etc., are used with reference to this position. It will be understood, however, that the closure of this invention may be manufactured, stored, transported, used, and sold in an orientation other than the position described.

Some of the figures illustrating embodiments of the closure show structural details and mechanical elements that will be recognized by one skilled in the art. However, the detailed descriptions of such elements are not necessary to an understanding of the invention, and accordingly, are not herein presented.

A first form of a closure having a tamper-evident feature which blends in with, or enhances, the cosmetic appearance of the closure is illustrated in FIGS. 1-9 and is designated generally therein by the reference numeral 30. The closure 30 is adapted to be mounted on a container (not shown) The container may be of any suitable special or conventional type and typically has a neck which receives the closure 30 and which defines an opening 38 through which the container contents can be dispensed.

Figure 8:
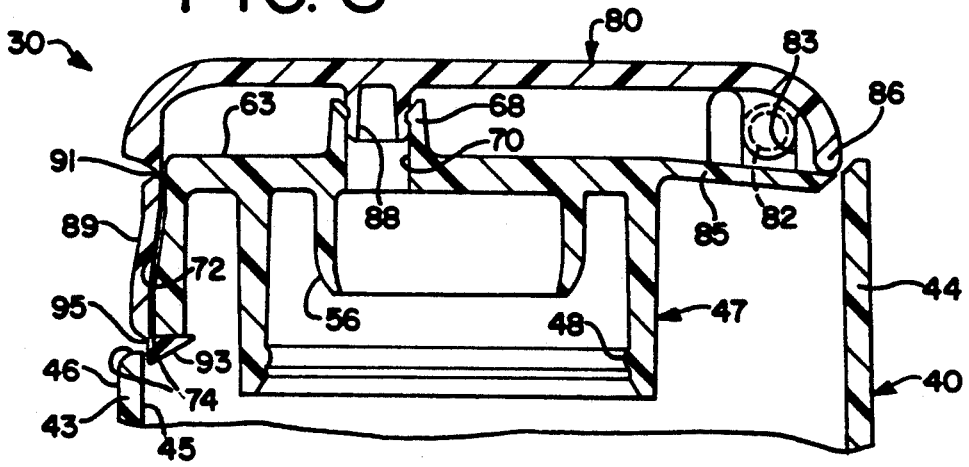
FIG. 8 is an enlarged, fragmentary, cross-sectional view taken generally along plane 8—8 in FIG. 3.
Figure 9:
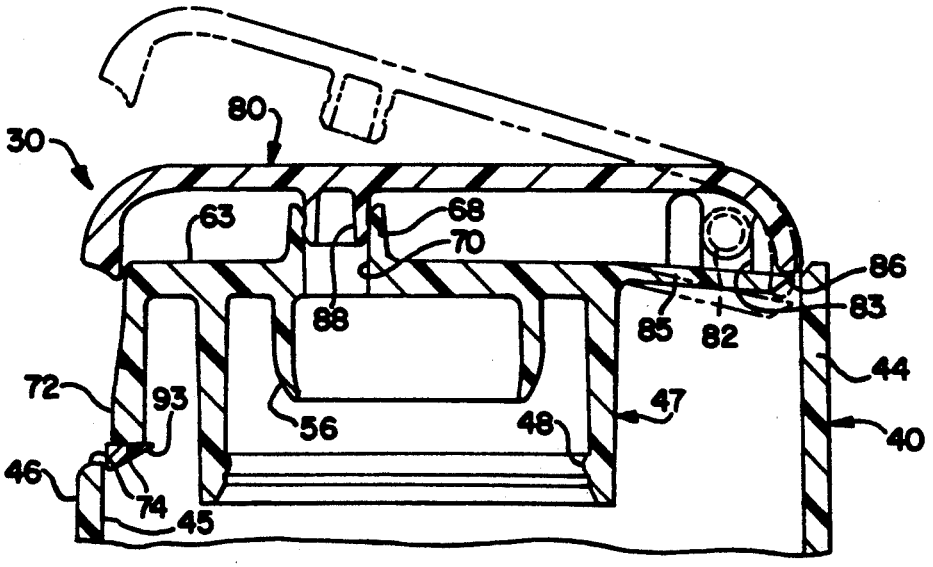
FIG. 9 is a view similar to FIG. 8 but showing the closure with the tamper-evident panel removed and showing a moved position of the lid in phantom as indicated by dashed lines.

As best illustrated in FIGS. 8 and 9, the closure 30 includes a housing, base, or body 40 for securement to the container. The closure body 40 includes a peripheral wall in the form of a skirt 44 which has an interior surface 45 and an exterior surface 46 (FIGS. 8 and 9).

The skirt 44 includes a conventional inner collar 47 with a snap-fit bead 48 or other suitable means (e.g., a thread (not illustrated)) for engaging a suitable cooperating means, such as a bead, on the container neck to secure the closure body 40 to the container.

The closure body 40 also includes resilient, internal ring 56 which functions as a seal by protruding into and against the container neck.

Figure 2:
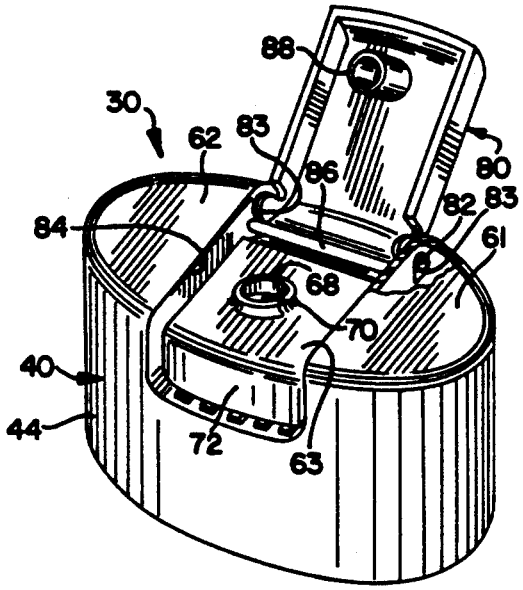
FIG. 2 is a view similar to FIG. 1 but showing the closure with the tamper-evident panel removed and the lid in an open position.
Figure 5:
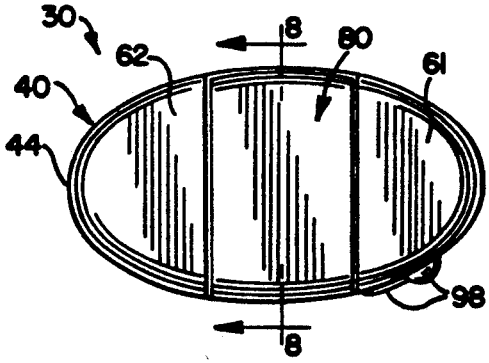
FIG. 5 is a top plan view of the closure shown in FIG. 1.
Figure 7:
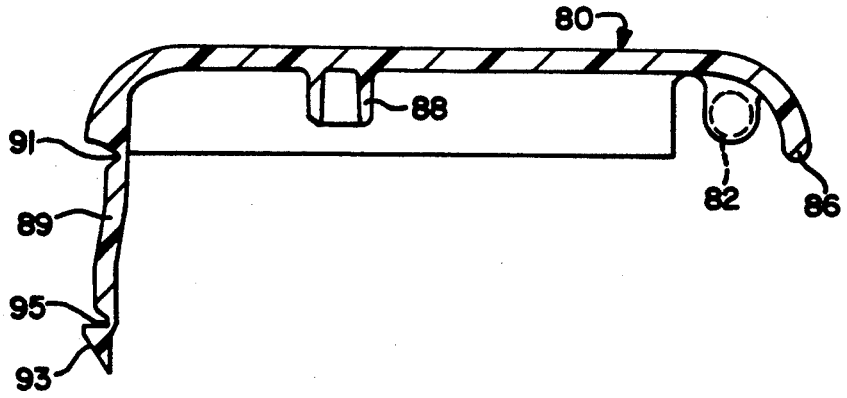
FIG. 7 is an enlarged, cross-sectional view of the closure lid prior to assembly on the closure base.

As best illustrated in FIG. 2, the closure body 40 includes a deck structure comprising two spaced-apart, horizontal, outer deck portions defining top surfaces 61 and 62 and comprising a recessed central deck portion 63 between the outer deck portion surfaces 61 and 62. The surfaces 61 and 62 are generally flat and co-planar The central deck portion 63 includes a collar 68 which projects upwardly around a cylindrical dispensing aperture or orifice 70 (FIGS. 5 and 7).

As illustrated in FIGS. 2 and 9, the body skirt 44 includes a recessed wall portion 72 terminating in a lower end defining a slot or aperture 74 (FIG. 9) adjacent a lower wall portion 43 of the skirt 44. The aperture 74 functions as an anchor-receiving aperture as will be described in detail hereinafter.

A flow control means in the form of a lid 80 is disposed on the body 40 between the two spaced-apart outer deck portion surfaces 61 and 62 and over the central deck portion 63. The lid 80 is adapted to be moved between an open position (FIGS. 2 and 9) permitting the dispensing of the container contents and a closed position (FIGS. 1, 3-6, and 8) in which the dispensing orifice 70 is occluded.

The lid 80 also preferably includes a downwardly projecting plug 88 (FIGS. 2 and 8) for entering into the dispensing orifice 70 when the lid is closed (FIG. 1) to occlude the opening.

The lid 80 may be completely removable from the closure body 40 or may be attached to it In the embodiment illustrated in FIGS. 1-9, the lid 80 is connected to the closure body 40 by a snap-action hinge structure of the general type disclosed in the allowed, pending U.S. patent application Ser. No. 07/484,226. The disclosures of that application are incorporated herein by reference thereto to the extent that such disclosures are not inconsistent with the present disclosure.

The snap-action hinge structure for the lid 80 includes a pair of oppositely extending journals or pins 82. The pins 82 are each received in a suitable bearing opening 83 (FIGS. 2, 8, and 9) defined in a vertical wall 84 (FIG. 2) which projects upwardly from, and on either side of, the recessed central deck portion 63.

As best illustrated in FIG. 8, the central deck portion 63 includes a cantilevered, rear spring deck 85, and the rear end of the lid 80 includes a cam portion 86 for engaging the spring deck 85 as the lid 80 is pivoted upwardly relative to the axis defined by the pins 82.

Preferably, the closure body 40 and lid 80 are molded from suitable thermoplastic materials compatible with the container and contents, and the body material permits the spring deck 85 to be resiliently or elastically deflected or deformed downwardly (FIG. 9) in response to the force imposed by the convex surface of the cam portion 86.

As the lid 80 is moved from the fully closed position (FIG. 8) to the fully open position (FIG. 2), the spring deck 85 reaches the point of maximum deflection, and this may be characterized as the "over center" position in which the spring deck 85 is most stressed On either side of the over center position, the deflection of the spring deck 85 is reduced and the stress is less The stress and deflection decrease with increasing angular movement of the lid 85 away from the over center position The lid 80 is thus urged to a stable position at the end of its travel range on one side or the other relative to the over center position. In this manner, when the lid 80 is closed, it is self-maintained in the closed position On the other hand, when the lid 80 is opened, it is self-maintained in that position (FIG. 2) to accommodate dispensing of the contents without having to use one's fingers to hold the lid 80 out of the way.

The above-described particular hinge structure forms no part of the present invention. Other suitable hinge structures may be provided For example, the cam-actuated lid mounting structure disclosed in U.S. patent No. 4,887,747 could be employed. Also, the lid 80 could be connected with a unitary, molded, living hinge to the closure body 40.

A novel tamper-indicating member 89 is connected to the front end of the lid 80 as illustrated in FIGS. 1, 7, and 8. The member 89 is received within the recess defined by the recessed upper wall portion 72 in the closure body 40. Preferably, the tamper-indicating member 89 is molded as a unitary part of the lid 80. A first frangible connecting means, such as a reduced-thickness portion or web 91, is defined between the front edge of the lid 80 and the tamper-indicating member 89 to form the connection between the lid 80 and member 89.

As shown in FIGS. 7 and 8 for the illustrated preferred embodiment, an anchor means 93 is molded as a unitary extension of the member 89. The anchor means 93 is connected to the bottom of the tamper-indicating member 89 with a second frangible connecting means 95. The second frangible connecting means 95 is defined between the bottom edge of the front end of the tamper-indicating member 89 and the anchor means 93.

Figure 3:
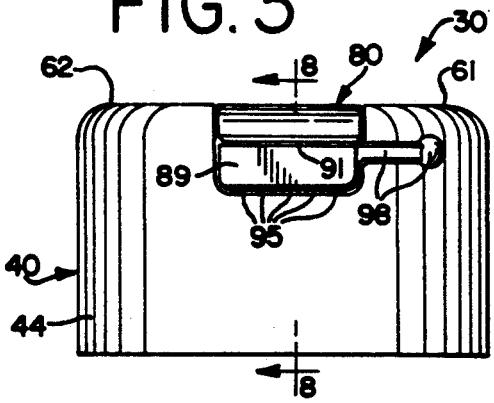
FIG. 3 is a front elevational view of the closure shown in FIG. 1
Figure 4:
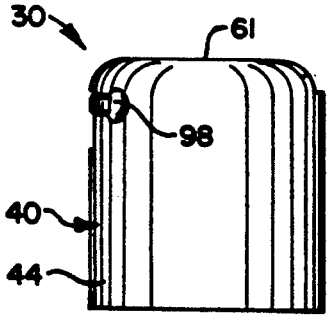
FIG. 4 is a side elevational view of the closure shown in FIG. 1.

In the preferred embodiment illustrated in FIG. 7, the anchor means 93 is in the form of a plurality of spaced-apart retaining bars each having a wedge-shaped cross section, and the second frangible connecting means 95 includes a series of spaced-apart webs which are unitary with the tamper-indicating member 89 and with the retaining bars of the anchor means 93 (FIGS. 3 and 7).

During fabrication of the closure, the lid 80 is mounted to the closure base 40, and the retaining bars of the anchor means 93 are inserted through the anchor-receiving aperture 74. To accomplish this, the tapering ends of the wedge-shaped retaining bars are pushed into the aperture 74. The closure body upper wall portion 72 and/or the closure body lower wall portion 43 (FIGS. 8 and 9) are somewhat flexible and resilient so as to be temporarily spread apart to increase the size of the aperture 74 and permit insertion of the anchor means 93. The walls then return to the original, generally vertical orientation, and the large rear ends of the retaining bars of the anchor means 93 lie adjacent the inner surface 45 of the closure body lower wall portion 43. This prevents removal of the anchor means 93.

As can be seen in FIG. 8, the second frangible connecting means web 95 extends through the aperture 74 to connect with the tamper-indicating member 89 adjacent the exterior surfaces of the skirt upper wall portion 72 and lower wall portion 43.

Figure 6:
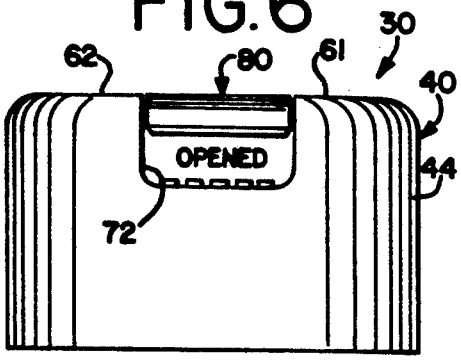
FIG. 6 is a view similar to FIG. 3 but showing the closure after removal of the tamper-evident panel.

A pull tab means or tab 98 (FIG. 1) is connected to the tamper-indicating member. The tab 98, in the illustrated preferred embodiment, is molded as a unitary extension of the tamper-indicating member 89. The tab 98 can be pulled to completely sever the member 89 from both the lid 80 and the anchor means 93 along the frangible connecting means 91 and 95. FIGS. 6 and 9 illustrate the closure after the tamper-indicating member has been removed For illustrative purposes, the severed bars of the anchor means 93 are shown still in the anchor position, prior to falling away from the aperture 74. After the member 89 has been removed, the lid 80 can be opened.

In the preferred embodiment illustrated in FIGS. 1–9, the frangible connecting means 91 and 95 are defined by reduced thickness portions of material which is present at the apex of a generally V-shaped notch (FIG. 7). Other forms of frangible connecting means could be employed, such as score lines, perforations, or the like.

In the preferred embodiment illustrated in FIGS. 1–9, the first frangible connecting means 91 and the second frangible connecting means 95 lie along lines which are generally parallel with the pivot axis.

In a preferred form of the invention, the frangible connecting means 91 and 95 are webs which have a thickness sufficient to prevent the lid 80 from being lifted upwardly when subjected to the forces typically applied by the average person's fingers (and without a tool). However, even if the frangible connecting means 91 and 95 were ruptured or broken by excessive forces, or by severing with a tool, then the broken tamper-indicating member 89 would thereafter provide evidence that either the closure had been opened or at least there had been an attempt to tamper with the closure.

It will also be appreciated that the anchor means 93 may be attached to the closure body without using the wedge shape retaining bar configuration and receiving aperture 74. For example, a suitably shaped anchor could be secured with sonic welding, adhesive, tabs, etc.

The tamper-indicating member may be adapted to carry indicia, such as the words "SAFETY SEAL". Upon removal, the recessed wall 72 is exposed, and that wall 72 may be adapted to carry indicia, such as the word "OPENED" as shown in FIG. 6. The indicia may be molded directly into the tamper-indicating member 89 and into the closure body wall 72 or may be printed on suitable labels that are adhesively applied.

In addition, the tamper-indicating member 89 may function as a proof-of-purchase feature. For example, a label bearing the desired instructions, codes, advertising, etc., may be applied to the inwardly facing or outwardly facing surface of the member 89. After the member 89 has been torn away from the closure, it can be used as a proof-of-purchase in the same manner as parts of conventional packages are typically used.

It will be appreciated that the tamper-indicating member 89 can be applied to a variety of closures and can accommodate novel modifications as will next be explained with reference to a second embodiment illustrated in FIGS. 10–13.

In the following description, three digit numbers in the 100 series are used to refer to the embodiment illustrated in FIGS. 10–13. The last two digits in each three digit number designate elements which are similar or functionally analogous to the elements identified with the same two digits in the first embodiment described above with reference to FIGS. 1–9.

The alternate form of the closure illustrated in FIGS. 10–13 is designated generally by the reference numeral 130. The closure 130 includes a housing, base, or body 140 for securement to a container (not illustrated). As in the first embodiment illustrated in FIGS. 1–9, the base 140 includes an external skirt 144 and an interior collar 147 for engaging the container.

Figure 10:
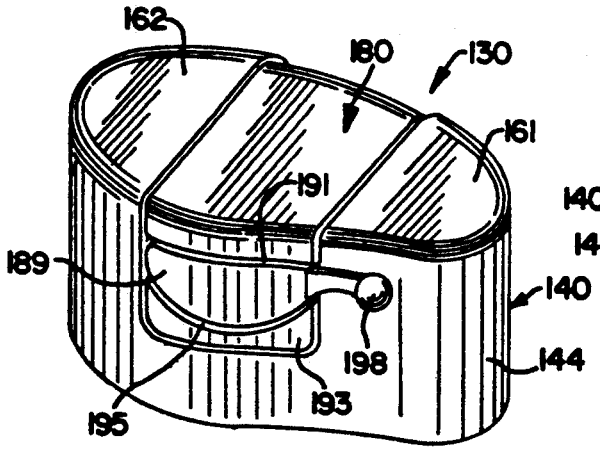
FIG. 10 is a perspective view of a second embodiment of the closure.
Figure 11:
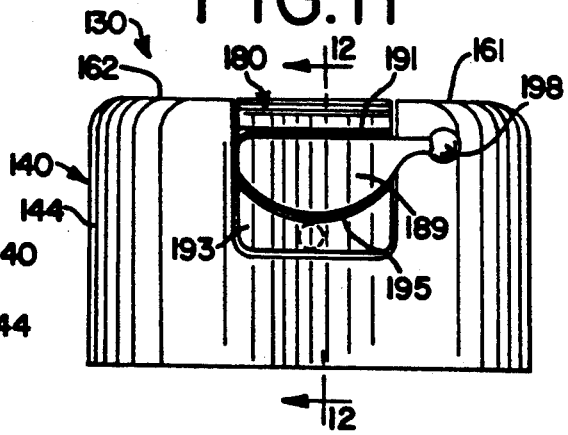
FIG. 11 is a front elevational view of the closure shown in FIG. 10.

As best illustrated in FIGS. 10 and 11, the closure body 140 includes a deck structure comprising two spaced-apart, horizontal, outer deck portions defining top surfaces 161 and 162. The closure body 140 has a recessed central deck portion 163 (FIG. 12) between the outer deck portion top surfaces 161 and 162. The central deck portion 163 includes a collar 168 which projects upwardly around a cylindrical dispensing aperture or orifice 170 (FIG. 13).

A flow control means, such as a lid 180, is disposed on the body 140 between the two spaced-apart outer deck portion top surfaces 161 and 162 and over the central deck portion 163. The lid 180 is adapted to be moved between an open position for permitting the dispensing of the container contents and a closed position (FIGS. 8–12) in which the dispensing orifice 170 is occluded. The lid 180 includes a downwardly projecting plug 186 (FIGS. 12 and 13) for entering into the dispensing orifice 170 when the lid is closed to occlude the opening.

In the embodiment illustrated in FIGS. 8–13, the lid 180 is pivotally mounted at one end to the closure body 140 in a manner similar to the mounting of the lid 80 in the first embodiment described above with reference to FIGS. 1-9.

Figure 12:
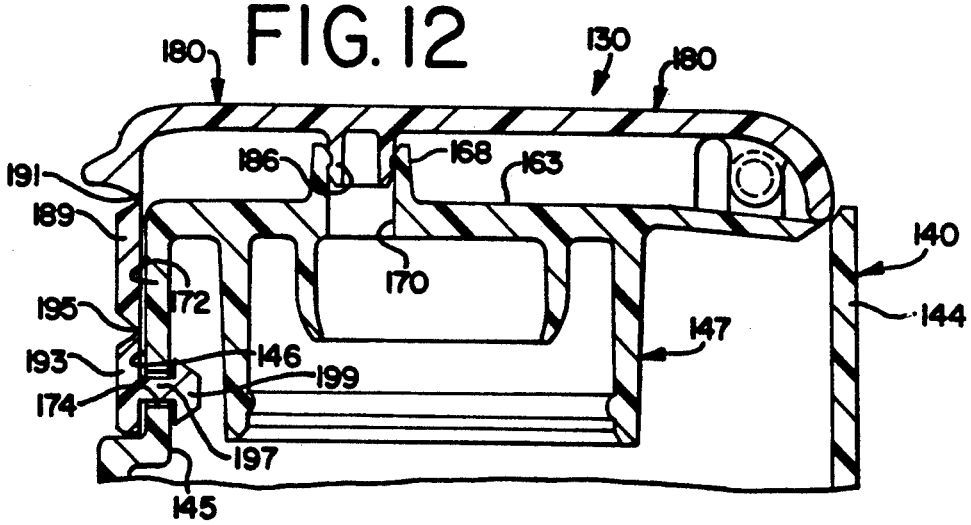
FIG. 12 is an enlarged, fragmentary, cross-sectional view taken generally along the plane 12—12 in FIG. 11.
Figure 13:
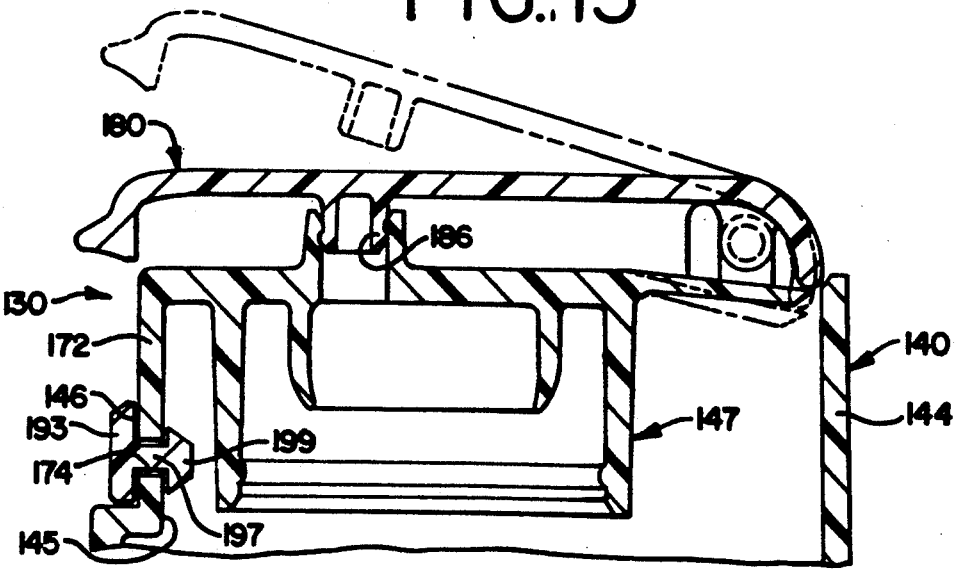
FIG. 13 is a view similar to FIG. 12 but showing the closure with the tamper-evident panel removed and showing a moved position of the lid in phantom as indicated by dashed lines.

As in the first embodiment described above with reference to FIGS. 1-9, the second embodiment closure body skirt 144 has a recessed vertical wall 172 (FIGS. 12 and 13). The wall 172 has an inner surface 145 and an outer surface 146. The wall 172 defines an anchor-receiving aperture 174 in the form of a bore extending between the surfaces 145 and 146.

The recessed wall 172 accommodates a tamper-indicating member 189 and anchor means 193. The member 189 and anchor means 193 are preferably molded as a unitary extension of the lid 180. The member 189 is connected via a first frangible connecting means or web 191 to the front end of the lid 180. As can be seen in FIGS. 10 and 11, the first frangible connecting means 191 is generally straight and is generally parallel to the top of the closure and to the closure lid pivot axis.

The bottom edge of the tamper-indicating member 189 is arcuate and is connected via a second frangible connecting means or web 195 to the anchor means 193.

Each of the frangible connecting means 191 and 195 is provided in the form of a reduced-thickness section of material defined by a generally V-shaped groove.

The anchor means 193 includes a pin 197 having an enlarged distal end or head 199 which has a frustoconical configuration. A transverse dimension of the head 199 is greater than a corresponding transverse dimension of the anchor-receiving aperture 174. The head 199 thus functions to retain the pin 197 and anchor means 193 on the closure body 140.

To facilitate assembly of the closure 130, the portion of the wall 172 around the anchor-receiving aperture 174 and/or the anchor means head 199 are resilient to accommodate insertion of the pin and head 199 into the aperture 174.

As illustrated in FIGS. 10 and 12, a pull tab 198 is formed as a unitary extension on the tamper-indicating member 189. The pull tab 198 can be gripped and used to pull the member 189 so as to completely sever the member 189 from the lid 180 and from the anchor means 193.

It will be apparent from the foregoing detailed description of the embodiments of the present invention that the present invention provides a novel tamper-indicating feature which can be furnished in a variety of closure designs. The novel tamper-evident feature blends with, and/or enhances, the cosmetic appearance of the closure. However, the tamper-evident feature can be easily manipulated by the user to permit the closure to be opened while at the same time giving a clear indication of such manipulation.

In the illustrated embodiments of the present invention, the anchor means (93 or 193) is shown as extending through an aperture in the closure body. It will be appreciated that another aspect of the present invention contemplates that the anchor means could be secured to the closure body with other structures or with other expedients (e.g., adhesive, sonic welding, etc.). Further, the novel tamper-indicating feature of the present invention may be incorporated with a variety of flow control elements (e.g., lids 80 and 180). For example, the tamper-indicating feature may be molded as part of a lid on a one-piece closure or as part of a pivotally mounted dispensing nozzle (e.g., such as disclosed generally in the U.S. Pat. Nos. 4,962,869 and 4,776,501).

It will be readily apparent from the foregoing detailed description of the invention and from the illustrations thereof that numerous other variations and modifications may be effected without departing from the true spirit and scope of the novel concepts or principles of this invention.

What is claimed is:

1. A tamper-evident dispensing closure comprising:

a body suitable for mounting on a container, said body defining a dispensing orifice for communicating with said container for dispensing the contents thereof, and said body defining an anchor-receiving aperture;

a flow control means disposed on said body for being moved between positions opening and closing said dispensing orifice;

a tamper-indicating member adjacent said flow control means and body;

a first frangible connecting means for connecting said tamper-indicating member to said flow control means;

an anchor means for being retained by said body and defining locking means for being inserted through said anchor-receiving aperture for engaging said body and preventing removal of said anchor means from said body; and a second frangible connecting means for connecting said anchor means to said tamper-indicating member whereby said tamper-indicating member can be pulled to sever said member from both said flow control means and anchor means along said first and second frangible connecting means and thereby permit the opening of said flow control means while providing evidence of tampering with said closure.

2. The closure in accordance with claim 1 which said body includes a skirt that has exterior and interior surfaces and that defines said anchor-receiving aperture extending between said surfaces.

3. The closure in accordance with claim 2 in which said anchor means includes a pin having an enlarged distal end with a transverse dimension greater than a transverse dimension of said anchor-receiving aperture; and said pin is disposed within said aperture with said enlarged distal end projecting from said aperture adjacent said body skirt to retain said pin within said body whereby said anchor means is retained by said body.

4. The closure in accordance with claim 3 in which at least one of said pin and said body skirt adjacent said aperture is resilient to accommodate insertion of said pin into said aperture.

5. The closure in accordance with claim 2 in which said anchor means includes a retaining bar with at least a portion disposed adjacent said skirt interior surface; and said second frangible connecting means extends through said aperture from said retaining bar and is connected with said tamper-indicating member adjacent said skirt exterior surface.

6. The closure in accordance with claim 1 in which said flow control means has a distal end edge; and said first frangible connecting means is substantially parallel to, and adjacent, said distal end edge.

7. The closure in accordance with claim 1 in which said body has two spaced-apart top surfaces and a peripheral skirt depending therefrom; and said flow control means has an upper surface that substantially conforms to said body top surfaces when said flow control means is in said closed position.

8. The closure in accordance with claim 7 in which said body has two spaced-apart outer deck portions each defining one of said top surfaces; and said body defines a recessed central deck portion for receiving said flow control means in said closed position.

9. The closure in accordance with claim 1 in which said flow control means is a lid hinged to said body;

said body includes a recessed central deck portion below said lid; and said central deck portion defines said dispensing orifice.

10. The closure in accordance with claim 1 in which said anchor-receiving aperture is a slot through said body.

11. The closure in accordance with claim 1 in which said closure further includes a pull tab unitary with said tamper-indicating member.

12. A tamper-evident dispensing closure comprising:

a body for mounting on a container, said body having a peripheral skirt and having a top wall defining a dispensing orifice for communicating with said container for dispensing the contents thereof;

a flow control means disposed on said body for pivoting about an axis between positions opening and closing said dispensing orifice, said flow control means having a distal end remote from said axis and adjacent said body skirt when said flow control means is closed;

a tamper-indicating member unitary with said flow control means;

a first frangible connecting means for connecting said tamper-indicating member to said flow control means distal end along a line generally parallel with said axis;

an anchor means unitary with said tamper-indicating member for being retained by said body skirt, said anchor means being non-unitary with said body skirt and separate from said body skirt; and a second frangible connecting means for connecting said anchor means to said tamper-indicating member whereby said tamper-indicating member can be pulled to completely sever said member from both said flow control means and anchor means along said first and second frangible connecting means and thereby permit the opening of said flow control means while providing evidence of tampering with said closure.

13. The closure in accordance with claim 12 in which said body is separate from, but attachable to, an open end of said container.

14. The closure in accordance with claim 12 in which said flow control means is a lid that is separate from, but attachable to, said body; and said closure further includes a pull tab unitary with said tamper-indicating member.

15. A tamper-evident dispensing closure comprising:

a body suitable for mounting on a container and defining a dispensing orifice for communicating with said container for dispensing the contents thereof, said body having a skirt with an exterior surface and an interior surface, said skirt defining an anchor-receiving aperture extending between said exterior and interior surfaces;

a flow control means disposed on said body for being moved between positions opening and closing said dispensing orifice;

a tamper-indicating member adjacent said flow control means and body;

a first frangible connecting means for connecting said tamper-indicating member to said flow control means;

an anchor means for being retained by said body, said anchor means including a retaining bar with at least a portion disposed adjacent said skirt interior surface; and a second frangible connecting means for extending through said anchor-receiving aperture from said retaining bar and connecting with said tamper-indicating member adjacent said skirt exterior surface; and a pull tab means connected to said tamper-indicating member for being pulled to sever said member from both said flow control means and anchor means along said frangible connecting means and thereby permit the opening of said flow control means while providing evidence of tampering with said closure.

16. The closure in accordance with claim 15 in which said flow control means is a pivotable member defining a generally flat upper surface;

said body has two spaced-apart top surfaces which are generally flat and co-planar; and said flow control means upper surface is generally co-planar with said top surfaces of said body when said flow control means is in said closed position.

17. The closure in accordance with claim 15 in which said retaining bar has a wedge-shaped cross section.

18. The closure in accordance with claim 15 in which said first frangible connecting means is a reduced thickness section of material relative to, and joining, said tamper-indicating member and said flow control means; and said second frangible connecting means includes a series of spaced-apart webs unitary with said tamper-indicating member and said anchor means.

19. The closure in accordance with claim 15 in which said body shirt includes a recessed wall portion above said anchor-receiving aperture and a lower wall portion below said aperture, at least one of said wall portions adjacent said aperture being resiliently deflectable away from the other at said aperture to accommodate insertion of said retaining bar through said aperture from the exterior of said skirt.

20. A tamper-evident dispensing closure comprising:

a body with a skirt suitable for mounting on a container, said body defining a dispensing orifice for communicating with said container for dispensing the contents thereof;

a lid disposed on said body and having a front end and a rear end, said lid being mounted adjacent said rear end for pivoting movement between positions opening and closing said dispensing orifice;

a tamper-indicating member connected by at least one first frangible web to said lid; and an anchor means for being retained by said body and connected by at least one second frangible web to said tamper-indicating member whereby said tamper-indicating member can be pulled to completely sever said member from both said lid and anchor means along said first and second frangible webs and thereby permit the opening of said lid while providing evidence of tampering with said closure, said anchor means being non-unitary with said body skirt and separate from said body skirt.

* * * * *

UNITED STATES PATENT AND TRADEMARK OFFICE

CERTIFICATE OF CORRECTION

PATENT NO. : 5,201,440

DATED : April 13, 1993

INVENTOR(S) : Richard A. Gross

It is certified that error appears in the above-identified patent and that said Letters Patent is hereby corrected as shown below:

Column 1, line 37, after "advantageous" insert --if such an improved closure could be initially opened relatively easily by the user.

It would also be beneficial--;

Column 1, line 54, insert a period after "opened";

Column 1, line 55, insert a period after "closure";

Column 2, line 6, insert a period after "means";

Column 4, line 43, insert a period after "less";

Column 4, line 56, insert a period after "provided"; and

Column 5, line 47, insert a period after "removed".

Signed and Sealed this

Eleventh Day of January, 1994

Bruce Lehman

*Attest:*

BRUCE LEHMAN

*Attesting Officer*

*Commissioner of Patents and Trademarks*